United States Patent [19]

Sando et al.

[11] 4,116,627

[45] Sep. 26, 1978

[54] METHOD FOR SEALING A HIGH PRESSURE STEAMER AND AN APPARATUS FOR CARRYING OUT THE SAME

[75] Inventors: Yoshikazu Sando; Hiroshi Ishidoshiro, both of Wakayama, Japan

[73] Assignee: Sando Iron Works Co., Ltd., Japan

[21] Appl. No.: 806,058

[22] Filed: Jun. 13, 1977

[30] Foreign Application Priority Data

Jun. 16, 1976 [JP] Japan ..... 51-70839
Jun. 16, 1976 [JP] Japan ..... 51-70840

[51] Int. Cl.[2] ..... D06B 23/18
[52] U.S. Cl. ..... 8/149.3; 34/242; 68/5 E
[58] Field of Search ..... 8/149.3; 277/1; 68/5 E; 34/242

[56] References Cited

U.S. PATENT DOCUMENTS 3,174,230 3/1965 Green et al. ..... 34/242 X

*Primary Examiner*—Philip R. Coe
*Attorney, Agent, or Firm*—Toren, McGeady and Stanger

[57] ABSTRACT

For sealing a high pressure steamer air, pressurized to a level higher than the internal pressurized medium, in the drum body of the high pressure steamer is directed against the mutually contacting portions of rubber seal rolls. Initially, the pressurized air flows over the outside of a cylindrical duct extending between the opening for the passage of textile articles into the drum body of the steamer and the rubber seal rolls and the air serves to block the flow of the pressurized medium within the steamer through the opening. Sealing plates positioned between the interior of the steamer and the seal rolls, are forced into contact with the seal rolls by the pressurized air. Further the flow of pressurized air collides with the internal pressure medium of the steamer within the cylindrical duct preventing the exhaust of the internal pressure medium through the cylindrical duct.

8 Claims, 2 Drawing Figures

METHOD FOR SEALING A HIGH PRESSURE STEAMER AND AN APPARATUS FOR CARRYING OUT THE SAME

BACKGROUND OF THE INVENTION

The present invention relates to a method of and apparatus for sealing with pressurized air the inlet and the outlet for textile articles in a high pressure steamer used for treating textile articles under high pressure, high humidity and high temperature.

In the past it has been well-known to use a high pressure steamer for treating textile articles under high temperature and high pressure by applying saturated vapor at temperature and high pressure to textile articles. Further the present inventors have already filed several applications as a result of various studies and experiments made over a period of many years based on methods and apparatuses for sealing a high pressure steamer through which textile articles are passed with the high pressure steamer being kept sealed for preserving its high internal pressure and temperature.

An apparatus of the up-to-date type to be used in effecting such a sealing method has already been developed by the present inventors and comprises a pair of sealing plates adapted to be pressed against a pair of mutually contacting rubber seal rolls which are pressurized with the internal pressure of the drum body of a high pressure steamer and are adapted to separate the interior of the steamer from the exterior thereof at a position as close as possible to the mutually contacting portions of the rubber seal rolls.

SUMMARY OF THE INVENTION

The present invention is aimed at providing an improved method of and apparatus for effective the sealing of a high pressure steamer based upon the foregoing apparatuses developed by the present inventors.

In other words, a method of sealing a high pressure steamer, according to the present invention, is characterized in that air pressurized to a level higher than the internal pressure of the drum body of the steamer, is blown against rubber seal rolls at the mutually contacting or nip portions thereof along an air supplying path about the outside of a cylindrical duct which has open ends and extends between the inlet of textile articles into the drum body of a high pressure steamer and the mutually contacting portions of a pair of rubber seal rolls for blocking the inlet of the textile articles and forms a passage for the textile articles therebetween, a pair of sealing plates interposed between the interior and the exterior of the steamer are placed in pressure contact with rubber seal rolls with the help of the pressurized air. Further, the pressurized air collides with the internal pressure of the steamer within the cylindrical duct at approximately the middle part thereof, and when the collision of two sources of pressurized air takes place, the internal pressure of the steamer is prevented from exhausting out of the cylindrical duct by virtue of the pressurized air, a part of which is discharged out of the cylindrical duct to preserve the internal pressure of the steamer.

Further, it is the aim of the present invention to provide an apparatus for sealing a high pressure steamer which comprises a pair of mutually contacting rubber seal rolls located at and blocking the opening formed on one side of a through hole into the drum body of a high pressure steamer through which textile articles pass into and out of steamer. Sealing plates are arranged to block the interior of the steamer from its exterior the sealing plates are disposed in pressurized contact with the surfaces of the rubber seal rolls at positions as close as possible to the mutually contacting portions of the seal rolls. A cylindrical duct is located within the through hole and communicates at one end with the interior of the steamer and its other end is positioned adjacent to the mutually contacting portions of the seal rolls. Air under pressure is supplied through a port, with the air being at room temperature or having been cooled, into the space between the cylindrical duct and the through hole. A concaved groove having exhaust holes at properly spaced locations encompasses the peripheral surface of the cylindrical duct at approximately the middle part of the duct in its longitudinal direction.

According to the method of the present invention pressurized air at room temperature or which has been cooled is fed through the air supply port and along the outside of the cylindrical duct and then is blown under blast pressure against the rubber seal rolls at the location of the mutually contacting portions thereof. The sealing plates are placed in pressure contact with the seal rolls by virtue of the pressure of the blast air. Further, since the air under pressure collides with the internal pressure of the steamer at approximately the middle part of the cylindrical duct, a part of the pressurized air is exhausted from the cylindrical duct at the location of the collision mentioned above for the effective maintenance of the internal pressure in the steamer.

The present invention is furthermore aimed at providing a sealing apparatus in which the rubber seal rolls and sealing plates, respectively, provided in the foregoing apparatus are constantly cooled by virtue of the pressurized air supplied at room temperature or after having been cooled and which is introduced through the air supply port, for preventing the denaturation and deformation of the seal rolls caused by heating, and thus an efficacious sealing action can be maintained.

The present invention will now be explained in detail with reference to the accompanying drawings by way of example in a form of embodiment of the invention.

BRIEF DESCRIPTION OF THE DRAWINGS

The drawings show an apparatus for carrying out the method according to the present invention, wherein.

DESCRIPTION OF THE PREFERRED EMBODIMENT

Figure 1:
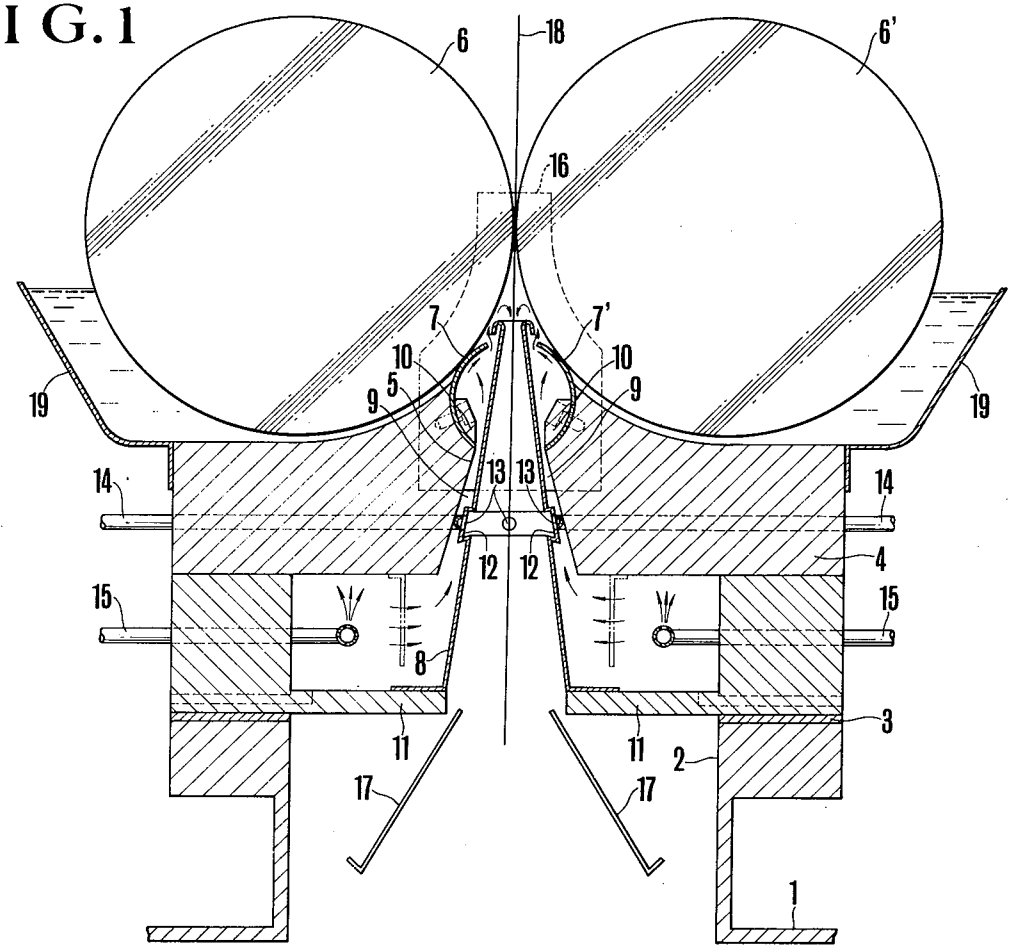
FIG. 1 is a vertical sectional view of the apparatus showing the whole structure thereof.

In FIG. 1, the reference numeral 1 designates the drum body of a high pressure steamer, and a seal block 4 is supported on an inlet 2 an textile articles into the drum body 1 of the high pressure steamer. Seal packing 3 is positioned between the drum body and the seal block formed in the inner part of the seal block 4 is a through hole 5 communicating with the drum body of the steamer. The reference numerals 6, 6' represent a pair of rubber seal rolls in mutual contact and rotatably mounted on the upper side of said seal block 4 for blocking the opening formed at the upper end of the through hole 5. A pair of curved resilient sealing plates 7, 7' are fixed at their lower ends by stop members 10 to the flange formed at the upper opening of the through hole 5 in the seal block 4, while seal sealing plates 7 and 7'. respectively are brought into resilient and pressed contact at their upper ends with rubber seal rolls 6 and 6'. The material used for the sealing plates 7, 7' is not specially defined in quality, however, in this embodiment, stainless steel sheet is utilized. The reference numeral 8 denotes a cylindrical duct tapering inwardly toward its upper end and disposed within the through hole 5. The interior of the cylindrical duct 8 forms a passage for textile articles passing between the pair of seal rolls 6, 6' and the interior of the drum body. Further, an air path 9 is formed between the outer peripheral surface of the cylindrical duct 8 and the inner surface of the through hole 5 for supplying pressurized air. Still further, the upper opening of the cylindrical duct 8 is located near the mutually contacting portions of the pair of rubber seal rolls, while the lower opening of the cylindrical duct 8 is securely fixed to protruding flanges 11 on the seal block 4. The reference numeral 12 indicates an outwardly projecting inwardly facing concave channel having a dovetail groove shape in section encompassing the outer periphery of the cylindrical duct 8 at approximately the middle part thereof in the longitudinal direction. The channel 12 is provided with exhaust holes 13 spaced an appropriate distance apart, and the exhaust holes 13 communicated with an exhaust pipe 14.

The reference numeral 15 represents an air supplying port for feeding air under pressure into the air path 9. The reference numeral 16 designates end surface sealing plates pressed against the ends of the rubber seal rolls 6, 6' as well as against the ends of the sealing plates 7, 7'. 17 denotes drain boards, 18 indicates textile articles to be treated, and 19 is a cooling water vessel through which the rubber seal rolls pass with a fractional part of the circumferential periphery of the rolls being located within the vessel.

Having described the construction of the apparatus utilized in the present inventive method the following is an explanation of its operation.

In operation of the apparatus, textile articles 18 are introduced into the drum body 1 of the steamer passing through both the mutually contacting portions of the rubber seal rolls and the inner part of the cylindrical duct 8, simultaneously with introduction of textile articles into the drum body, air under pressure and at room temperature or which has been cooled, the pressure of which is higher than the internal pressure within the drum body of the steamer is fed into the air path 9 from the air supply port 15, and the inside surfaces of the sealing plates 7, 7' are loaded with the pressure of the supplied air for achieving an effective sealing action by pressing each of the sealing plates 7 and 7' against the adjacent rubber seal roll. Further, the pressurized air acts on the sealing plates 7, 7' collides with the internal pressure acting within the drum body of the steamer flowing in the downward direction from the upper opening of the cylindrical duct 8 as is indicated by arrows in the drawing. Thus, leakage of the high temperature and high pressure from the drum body of the steamer can be effectively prevented without any accompanying ascent of the high temperature and high pressure from within the steamer along the inner part of the cylindrical duct. Moreover, the sealing plates as well as the rubber seal rolls can be favourably prevented from becoming heated by the pressurized air which is at room temperature or has been cooled and which is fed from the air supply port 15, thereby the rubber seal rolls and others can avoid denaturation as well as deformation thereof, and a permanent and effective sealing action can be achieved.

Figure 2:
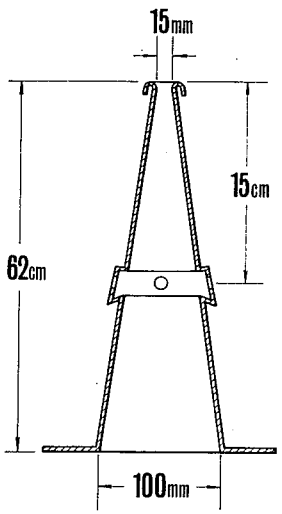
FIG. 2 is a detailed sectional view on an enlarged scale of an important part of the sealing apparatus consisting of a cylindrical duct.

For example, a more definite explanation follows concerning the sealing action of the apparatus constructed in the above mentioned mechanism with reference to the embodiment shown in FIG. 2.

In the case where the cylindrical duct is 62 cm in height, 100 mm in width at its lower opening and 15 mm on width at its upper opening, and further where the internal pressure within the drum body of the high pressure steamer is estimated at 5.5 kg/cm$^2$, and air at 7.5 kg/cm$^2$ is fed from the air supply port 15, the internal pressure medium width the high pressure steamer comes into collision with the supplied pressurized air at the position about 15 cm from the upper opening of the cylindrical duct, and it has been found that the internal pressure of the steamer is blocked by virtue of the supplied pressurized air. Subsequently, a part of the collied pressurized air is discharged from the duct through the exhaust pipe 14 to hold the pressure within the drum body of the steamer at a constant level.

Since a part the pressurized air for pressing the sealing plates 7, 7' against the rubber seal rolls 6, 6' is adapted to act on the space formed between the sealing plates 7, 7' and the rubber seal rolls 6, 6', pressurized contacting action between the sealing plates and the rubber seal rolls is more or less alleviated by virtue of the action exerted on the clearance between the sealing plates and the rubber seal rolls, thus the latter can be effectively and smoothly rotated.

Having elucidated previously on the function of the present inventive apparatus, the sealing action between the interior of the steamer drum body and the exterior thereof is carried out effectively owing to the fact that the sealing plates 7, 7' are brought into close contact under pressure with the rubber seal rolls by virtue of the action of the supplied pressurized air acting on both of the sealing plates 7 and 7' while the pressurized air supplied from the port 15 is higher than the internal pressure in the steamer drum body. Further, since the pressurized air is at room temperature or has been cooled, the sealing plates 7, 7' as well as the rubber seal rolls 6, 6' are prevented from experiencing a rise in temperature, whereby, in particular, are avoidable of denaturation as well as deformation of the rubber seal rolls due to heat and, moreover, the durability of rubber seal rolls can be enhanced the effective sealing action can be maintained for a long time.

Accordingly, a complete sealing action is achieved without any escape of the internal pressure medium from the drum body of the steamer to the outside thereof through the mutually contacting portions of the rubber seal rolls, so that, for instance, even when textile articles impregnated with a solution such as dyestuff and the like, on the outside of a steamer and then passed between the rubber seal rolls, the solution impregnated into the textile articles to be treated will not be blown away by leaking pressurized air effecting the sealing action, thus textile articles impregnated with a desired quantity of a solution is adapted to be effectively treated under a wet heat process in the steamer.

Furthermore, as described above, the concave channel 12, serving as a drain board, is provided about the outer periphery of the cylindrical duct 8 at about the middle part thereof in the longitudinal direction, so that moisture deposited on the inner surface of the cylindrical duct 8 in the upper part thereof can be recovered by concaved channel 12, whereby the textile articles 18 are not exposed to the deposit of drops of moisture, and the dyeing treatment, in particular, can be successfully carried out.

What is claimed is:

1. A method of sealing the inlet or outlet of a high-pressure steamer in which a textile article is treated by a fluid medium under high pressure and high temperature conditions with the textile article passing between a pair of mutually contacting seal rolls as it enters or exits the steamer, comprising the steps of forming a first air passage laterally enclosing a second air pressure with the air passages extending between the seal rolls and the inlet to or outlet from the steamer and the first and second passages being in fluid flow communication at the ends thereof adjacent the seal rolls, flowing air at a pressure higher than the pressure within the steamer and at a temperature at or below room temperature into the first air passage at a location spaced from the seal rolls and directing the flow of air through the first air passage into the space between the seal rolls adjacent the mutually contacting portions thereof, reversing the direction of flow of air into the end of the second passages adjacent the seal rolls and directing the flow of air through the second passage toward the steamer, admitting the fluid medium from the steamer into the adjacent end of the second passage, colliding the flow of air and the fluid medium within the second passage intermediate the ends thereof, and discharging at least a part of the flow of air through the second passage at a location spaced from both the opposite ends of the second passage.

2. A method, as set forth in claim 1, including balancing the flow of air and the fluid medium within the second flow passage.

3. Apparatus for sealing the inlet or outlet of a high pressure steamer in which a textile article is treated by a fluid medium under high pressure and high temperature conditions, comprising a high pressure steamer drum body having an opening for passing the textile article into or out of the drum body, wall means secured to said drum body forming a laterally closed passage communicating with and extending outwardly from the opening in said drum body, the passage having a first open end at the opening in said drum body and a second open end spaced outwardly from said drum body, a pair of seal rolls in contacting relation mounted on said wall means and forming a closure for the second end of said passage, a duct positioned in said passage and having a first end adjacent to the opening in said drum body and a second end adjacent and spaced closely inwardly from the contacting portions of said seal rolls, said duct spaced inwardly from the surface forming said passage and in combination therewith forming an annular first flow path about said duct, said duct forming a second flow path between the first and second ends thereof, said duct secured to one of said means and said drum body and forming a closure for the first flow path at the end thereof adjacent said drum body, the first and second flow paths being in fluid flow communication at the ends thereof adjacent said seal rolls, said wall means having an inlet aperture therein opening into the first flow path and spaced from both said seal rolls and said drum body for supplying air under pressure into the first flow path so that the air can flow toward the contacting portions of said seal rolls where its continued flow in that direction is blocked by the contacting portions of said seal rolls and the flow of air reverses direction and streams into the second flow path toward said drum body with the flow of air contacting the fluid medium from said drum body in the second flow passage, and means connected to said duct intermediate the ends thereof and extending exteriorly of said wall means for discharging at least a part of the flow of air streaming through the second flow path within said duct to a point exteriorly of the apparatus.

4. Apparatus, as set forth in claim 3, wherein said means for discharging the flow of air comprises an annular channel formed outwardly in and extending circumferentially around said duct intermediate the ends thereof, apertures in said duct opening into said annular channel, and conduit means connected to said apertures for conveying the flow of air from the second flow path in said duct to a point exteriorly of the apparatus.

5. Apparatus, as set forth in claim 4, wherein said duct has a circular cross section tapering inwardly from the first end to the second end thereof.

6. Apparatus, as set forth in claim 5, wherein said duct has a length of 62 cm between the first and second ends thereof, and a diameter of 100 mm at the first end and a diameter of 15 mm at the second end.

7. Apparatus, as set forth in claim 6, wherein said concave channel in said duct is located 15 cm from the second end thereof.

8. Apparatus, as set forth in claim 3, including a pair of sealing plates located within said passage in said wall means and mounted on said wall means adjacent said seal rolls, said sealing plates each located radially outwardly from said duct and on a diametrically opposite side thereof, said sealing plates having a concave side and a convex side with the concave sides facing one another and said convex sides each disposed in contact with a different one of said seal rolls, said sealing plates being located at the end of said first flow path adjacent said seal rolls so that the flow of air therethrough presses the sealing plates against said seal rolls.

* * * * *